US006606074B1

(12) United States Patent
Allnutt

(10) Patent No.: US 6,606,074 B1
(45) Date of Patent: Aug. 12, 2003

(54) DUAL BAND SATELLITE COMMUNICATIONS ANTENNA SYSTEM WITH CIRCULAR POLARZATION

(75) Inventor: Richard A. Allnutt, Beavercreek, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 10/118,615

(22) Filed: Apr. 3, 2002

(51) Int. Cl.[7] ..... H01Q 21/12

(52) U.S. Cl. ..... 343/815; 343/797; 343/819

(58) Field of Search ..... 343/792.5, 793, 343/797, 810, 815, 816, 817, 818, 819, 820

(56) References Cited

U.S. PATENT DOCUMENTS

| | | | | | |
|---|---|---|---|---|---|
| 1,745,342 | A | | 1/1930 | Yagi | |
| 3,918,063 | A | | 11/1975 | Nakamichi et al. | |
| 4,198,641 | A | * | 4/1980 | Gibson | 343/797 |
| 5,625,367 | A | | 4/1997 | Unwin | |
| 5,898,410 | A | * | 4/1999 | DeMarre | 343/792.5 |
| 6,154,180 | A | * | 11/2000 | Padrick | 343/722 |
| 6,307,524 | B1 | * | 10/2001 | Britain | 343/795 |
| 6,498,589 | B1 | * | 12/2002 | Horii | 343/727 |

OTHER PUBLICATIONS

Arrow Antenna Company, Cheyenne, Wyoming; "Arrow II Satellite" handheld VHF/UHF antenna (partial data sheet and drawing enclosed).

M2 Inc., Fresno, California; "2M5–440XP" VHF/UHF two band (146 megahertz and 440 megahertz) cross polarized orthogonal element planes antenna (partial data sheet and drawing enclosed).

M2 Inc., Fresno, California; "2MCP14" single band (143—148 megahertz) circularly polarized orthogonal element planes antenna (partial data sheet and drawing enclosed).

M2 Inc., Fresno, California; "2MCP22" single band (146 megahertz circularly polarized orthogonal element planes antenna (partial data sheet and drawing enclosed).

M2 Inc., Fresno, California; "136T/149RCP14" VHF two frequency (135 megahertz and 149 megahertz) circularly polarized orthogonal element planes antenna (partial data sheet and drawing enclosed).

The textbook "Antenna Engineering Handbook" Second or other edition, by Richard C. Johnson and Henry Jasik, McGraw–Hill Book Company, 1984.

* cited by examiner

*Primary Examiner*—Don Wong
*Assistant Examiner*—Shih-Chao Chen
(74) *Attorney, Agent, or Firm*—Gerald B. Hollins; Thomas L. Kundert

(57) ABSTRACT

A hand-held dual frequency satellite communication antenna of circular polarization-capable characteristics is disclosed. The antenna system is based on Yagi/Udi spaced elements, including tuned trap-enabled dual frequency elements, disposed in orthogonal planes of a hand-receivable antenna boom element. The antenna system is fabricated from low cost readily obtainable materials and in a manner permitting easy disassembly and packaging for carriage to an isolated location of usage. Configuration of the disclosed antenna system for transmission and reception in two different popular amateur radio satellite communication bands is included. Antenna system field pattern characteristics and actual element lengths are included in the disclosure.

18 Claims, 7 Drawing Sheets

DUAL BAND SATELLITE COMMUNICATIONS ANTENNA SYSTEM WITH CIRCULAR POLARZATION

RIGHTS OF THE GOVERNMENT

The invention described herein may be manufactured and used by or for the Government of the United States for all governmental purposes without the payment of any royalty.

BACKGROUND OF THE INVENTION

The development of "micro-satellites" has occasioned the use of multiple inexpensive orbiting satellite communication platforms. These communication platforms may be used by military, commercial, and amateur radio communicators for both digital and analog signal communications and usually involve communication over distances of five hundred to two thousand kilometers along a line of sight path inclusive of atmospheric and free space media. Older arrangements for communicating via such satellite platforms require substantial antenna gain for the uplink communication, the downlink communication, or both. This often means the operator needs to employ an elaborate ground antenna in order to use the satellite.

In recent years, radio amateurs have developed hand held antenna systems for use with low orbit satellites such as the satellites sponsored by many local chapters in their fraternity. Unfortunately, these antenna systems have often been characterized by a linear polarization characteristic and the operators have thereby experienced considerable fading in the communication these antennas support, fading as a result of the slow spin or tumble of the microsatellites and the antenna system incorporated therein. These fades in communication can however be minimized with the use of circularly polarized antenna systems. None of the thusly needed circularly polarized antenna systems are known however to have been developed in a package which is both strongly directional and sufficiently light to enable handheld antenna disposition.

Another disadvantage of the available circularly polarized antennas lies in their assembled configuration. These antennas normally function in only one frequency band and must therefore be physically tied to a similarly directed antenna, using for example a cross linking boom, in order to support the second frequency band often used in a two-way satellite communication arrangement. In addition to being cumbersome during use, assembly or disassembly of such a combination of antennas is usually burdensome to an excessive degree. The antenna system of the present invention can however provide this multiple band communication in a form that may be assembled or disassembled in a few minutes. In disassembled form the present invention antenna system comprises a light and easily carried bundle. In assembled form the antenna system comprises a fully capable, directional, dual band antenna system, an antenna system of circular polarization in at least one of its operating bands and an antenna system especially suited to satellite communication but usable for other purposes, portable and fixed, as well. One such other purpose for an antenna system of this type is for example often employed in the amateur radio fraternity in connection with the "hidden transmitter hunt" events used to exercise direction-finding equipment; another purpose includes the direct ground to aircraft communication (without intervening satellite) used by special operation forces and others in present day military actions.

SUMMARY OF THE INVENTION

The present invention provides a handheld dual band satellite communication antenna system of partial or complete circular polarization characteristics.

It is therefore an object of the present invention to provide a lightweight relatively small dual band antenna system suited to satellite and other communication needs in the UHF and VHF bands of radio frequency.

It is another object of the invention to provide a lightweight relatively small dual band antenna system that may be disassembled into an easily carried package.

It is another object of the invention to provide a lightweight relatively small dual band antenna system that may be assembled from a carried package form to a functional antenna system form in a short time interval.

It is another object of the invention to provide a lightweight relatively small dual band antenna system having circular polarization characteristics in one or both of its operating bands.

It is another object of the invention to provide a lightweight relatively small dual band antenna system that may be easily adapted to alternate operating frequencies.

It is another object of the invention to provide a lightweight relatively small dual band antenna system that may be used for either signal transmission or reception functions on either of two operating frequency bands.

It is another object of the invention to provide a dual band antenna system that seizes upon the tuned trap element arrangement for achieving dual band antenna element operation.

It is another object of the invention to provide a lightweight relatively small dual band antenna system having favorable, significant gain-inclusive, field pattern characteristics in each of its operating frequency bands.

It is another object of the invention to provide a lightweight relatively small dual band antenna system that may be fabricated from readily available, low cost, materials.

It is another object of the invention to provide a lightweight relatively small dual band antenna system that may be fabricated from a variety of alternate materials of differing physical and structural characteristics.

It is another object of the invention to provide a lightweight relatively small dual band antenna system that may be physically disposed in either hand held or fixed permanent mounting arrangements.

It is another object of the invention to provide a lightweight relatively small dual band antenna system that may be disposed in a variety of transmitter power level compatible configurations including an easily achieved 100 watt configuration.

It is another object of the invention to provide a lightweight relatively small dual band antenna system that is compatible with low earth orbit satellite apparatus having no more than ten watts of input energy.

It is another object of the invention to provide a lightweight relatively small dual band antenna system incorporating the advantages of the Yagi-Udi element arrangement.

It is another object of the invention to provide a lightweight relatively small dual band antenna system combining a single plane two-frequency linearly polarized antenna with a second plane antenna adding circular polarization characteristics.

It is another object of the invention to provide a lightweight relatively small dual band antenna system that may be easily and accurately reproduced.

It is another object of the invention to provide a lightweight relatively small dual band antenna system providing relatively low standing wave ratio electrical characteristics in each of its operating bands.

It is another object of the invention to provide a lightweight relatively small dual band antenna system having one embodiment that is suited to operation in the seventy centimeter and two meter wavelength operating bands.

These and other objects of the invention will become apparent as the description of the representative embodiments proceeds.

These and other objects of the invention are achieved by dual band circular polarization-capable portable antenna apparatus comprising the combination of:

an ultra high radio frequency first array of dipolar antenna elements disposed in a first geometric plane and extending along an antenna boom member in ultra high radio frequency Yagi/Uda element separations;

said ultra high radio frequency first array of dipolar antenna elements including an ultra high radio frequency energy radiator element disposed intermediate an ultra high radio frequency reflector element and a plurality of ultra high radio frequency director elements along said antenna boom member;

an ultra high radio frequency and very high radio frequency second array of dipolar antenna elements extending in ultra high radio frequency Yagi/Uda element separations along said antenna boom member within a second geometric plane orthogonal of and coaxial of said first geometric plane;

said ultra high radio frequency and very high radio frequency second array of dipolar antenna elements including an ultra high radio frequency energy radiator element disposed intermediate an ultra high radio frequency reflector element and a plurality of director elements, including dual radio frequency wavelength director elements of combined very high radio frequency and tuned wave-trap limited ultra high radio frequency effective electrical lengths, along said antenna boom member;

said dual radio frequency director elements of combined very high radio frequency and tuned wave-trap limited ultra high radio frequency effective electrical lengths additionally comprising a very high radio frequency-tuned antenna energy radiator element and a very high radio frequency-tuned antenna director element;

said ultra high radio frequency and very high radio frequency second array of dipolar antenna elements extending in said second geometric plane along said antenna boom member in interspersed antenna elements relationship with said first geometric plane first array of ultra high radio frequency dipolar antenna elements;

an electrical signal frequency responsive and signal phase splitting electrical network apparatus disposed intermediate an electrical port of said circularly polarized portable antenna apparatus and each of said antenna energy radiator elements;

said signal phase splitting electrical network of said electrical signal frequency responsive and signal phase splitting electrical network apparatus having output signal ports connecting with said ultra high radio frequency energy radiator elements of said first and second arrays of dipolar antenna elements in circular polarized wave generating element phasing determination.

By way of clarification and explanation, it may by now be appreciated, that to the best degree reasonably possible in drafting the present descriptive material, an attempt is made to use the expression "antenna system" or "antenna apparatus" or similar terminology when referring to the overall FIG. 1 or FIG. 2 apparatus and to employ the word "antenna" or "antenna element" or "element" when making generic reference to an antenna or reference to components or lesser assemblies or individual elements included within the complete apparatus.

BRIEF DESCRIPTION OF THE DRAWING

The accompanying drawings incorporated in and forming a part of the specification, illustrates several aspects of the present invention and together with the description serve to explain the principles of the invention. In the drawings.

DETAILED DESCRIPTION OF THE INVENTION

Figure 1:
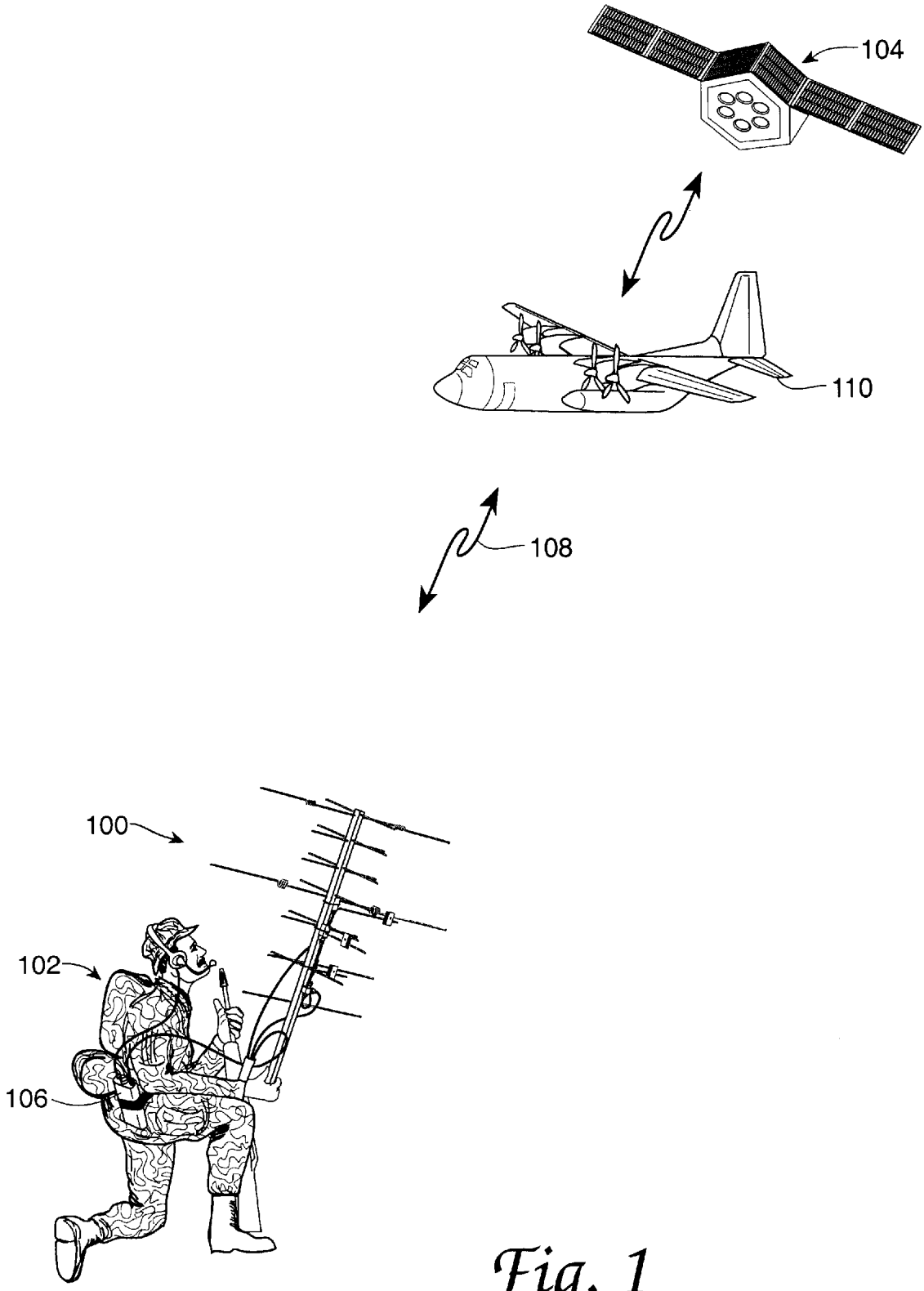
FIG. 1 shows an antenna system according to the present invention used in a satellite communication application.

FIG. 1 in the drawings shows an antenna system 100 made in accordance with the present invention in a contemplated significant uses setting. In the FIG. 1 drawing a person 102, such as a U.S. Air Force Special Operations Forces team member, is represented to be communicating between a remote deployment location and a low orbit satellite 104 using a portable transmitter and receiver apparatus 106 and the antenna system 100. Communication of this nature may for example be requesting airborne munitions delivery to an enemy held location or arranging for a Special Operations Forces team pickup at the termination of a temporary deployment mission. This communication especially in the satellite instance occurs along the path 108 often using two different radio frequency signal bands, bands located in the UHF and VHF frequency spectrums for example. The communication along path 108 may ultimately involve other persons located in the battle theatre at a relatively short distance away or persons located at a greater distance, the latter through use of satellite relay or satellite to earth relay arrangements as are known in the present day communication art. The communication along path 108 may also involve an aircraft such as is represented at 110 in the FIG. 1 drawing. Needed communication may also be of a direct point to point nature with others in the theatre and thus may be accomplished directly with the antenna system 100, and may include a similar antenna system at the opposite end of the communication link.

In a satellite communication event such as is represented in the FIG. 1 drawing both the uplink transmission between the person 102 and the satellite 104 and the downlink communication between the satellite 104 and the person 102 are limited by the relatively small quantities of electrical energy conveniently available for such communication purposes. The uplink communication along the path 108 can for example be limited to transmitter power levels of less than ten watts by reason of need for human carrying of the batteries or other transmitter energy source apparatus. The down link communication along path 108 can be limited to even lower energy levels (of for example 0.3 to 3.0 watts) by reason of the need to obtain satellite transmitter energy from batteries, solar cells or nuclear sources all of which must be disposed in earth orbit at significant expense and with desired long operating life.

Satellite communication along the path 108 may be complicated by the fact that the satellite 104 is not disposed in a fixed orientation with respect to the earth but is instead rotating or tumbling in its earth orbit. Even though there are fixed satellite orientation arrangements known in the satellite and satellite communications art such arrangements add significant complexity and operating life considerations to a satellite system and are preferably omitted in simple and cost-considered "low tech" apparatus. Such omissions are made in contemplation of making other accommodations such as accepting weaker signal reception or reorienting the signal-receiving antenna system 100 in response to satellite rotation-induced modulation of the downlink signal along path 108. As a result of using a dipole antenna on the satellite such downlink signals are often of a "planar polarized" nature and therefore optimally received at the antenna system 100 when a planar polarized antenna system at this location is reoriented in synchronization with the satellite movement.

A significant advantage of the present invention antenna system lies in fact in the concept that the antenna system disclosed herein may generate and optimally receive signals that are of a circularly polarized nature rather than of the planar polarized nature. In fact signals generated and received by the antenna system of the present invention may be electively polarized in either the right hand or the left hand circular polarizations by way of rearranging the electrical signal to antenna system element coupling arrangements used. The accomplishment of this circular polarization in the present invention antenna system has the practical advantage of the person 102 in FIG. 1 not being required to reorient the antenna system 100 in synchronism with motion of satellite 104 even during the presence of weaker signals, signals otherwise possibly requiring antenna system reorientation or acceptance of partial signal loss. A significant distinction of the present invention embodiment of antenna system 100 over the antennas heretofore used in situations such as represented in FIG. 1 lies in the fact that the present antenna system can provide both dual band operation and circular polarization characteristics.

In an environment of limited transmitter operating power levels signal polarization characteristics are but one of several considerations of interest in achieving optimum communication. Another significant consideration toward this goal resides in the signal enhancement or gain characteristics of the antenna system used by the person 102 and by the satellite 104. Generally it is considered desirable to employ antenna systems of significant directivity or direction-selective characteristics (and thereby of greater orientation accuracy requirement) in each of antenna system 100 and the satellite 104 locations in order to enhance the signal to noise ratio achieved in the receiver at each end of path 108. As described below herein the antenna system of the present invention incorporates a plurality of elements including dipolar energy radiating elements, dipolar reflector elements and a plurality of dipolar energy director elements all preferably disposed in the manner of the Yagi-Udi antenna in order to enhance the achieved directivity and effective signal gain characteristics. The antenna system of the present invention also employs a second array of Yagi-Udi elements disposed in an offset second antenna plane in order to enhance the achieved receiver signal levels through use of circularly polarized antenna characteristics. It is the offset nature of the two planes fed simultaneously which forms the circularly polarized field.

Details regarding the Yagi-Udi antenna are disclosed in the U.S. Pat. No. 1,745,342 of Yagi and in numerous technical references, references including the textbook "Antenna Engineering Handbook" Second Edition, by Richard C. Johnson and Henry Jasik, McGraw-Hill Book Company, 1984; in the Udi technical article "Wireless Beam of Short Electric Waves" appearing in the Journal of the Institute of Electric and Electronic Engineers, Japan, Number 452, March 1926, at pages 715–741 and also in Number 472, November 1927, pages 1209–1219 and in the Yagi technical article "Beam Transmission of Electric Waves" appearing in the Proceedings of the Institute of Radio Engineers, volume Jun. 16, 1928, pages 715–741. Each of these patent and other writings is hereby incorporated by reference herein.

Figure 2:
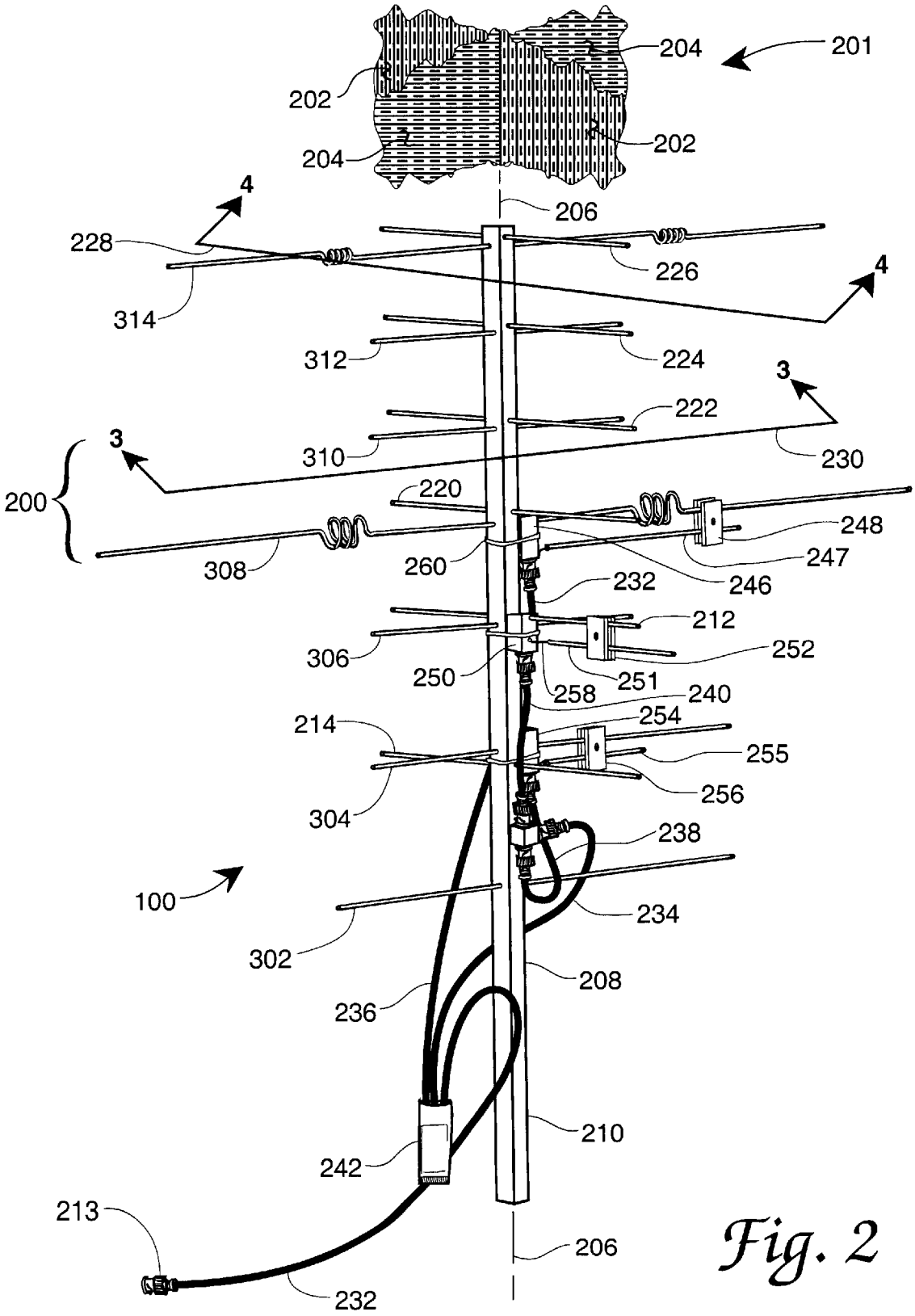
FIG. 2 shows a perspective view of an antenna system according to the present invention.

FIG. 2 in the drawings shows a more detailed perspective view of an antenna system, such as the FIG. 1 antenna system 100, made in accordance with the present invention. As may be observed in the FIG. 2 drawing the represented antenna system is comprised of a plurality of dipolar elements 200 disposed within two geometric planes of the intersecting plane assemblage 201. These two planes of the assemblage 201 are represented at 202 and 204 and are represented as coaxial geometric planes orthogonally dispersed around an axis 206 centered in the antenna system boom member 208. The boom member 208 includes a handle portion 210 disposed at a boom extremity along the axis 206 and convenient for manual disposition of the antenna system by the person 102 or other user. The boom member 208 may extend axially for whatever distance is needed for the antenna elements 200 in the direction opposite the handle portion 210; a length of about thirty-one and one half inches is sufficient to receive the FIG. 1 and FIG. 2 illustrated antenna elements in the case of the herein described 70 centimeter and 2 meter combination of communicated signal wavelengths and element separations of four and one-half inches to six and one-half inches in each of planes 202 and 204. Additional lengths from four and one-half inches upward may be added to the boom for handle or other mounting purposes. The boom member 208 may also be disposed for camera tripod or other fixed or semi-fixed mounting of the antenna system 100.

In the first of the FIG. 2 geometric planes 202 the antenna system 100 may be observed to include the combination of six dipolar elements, elements 214, 212, 220, 222 224 and 226. These elements are spaced along the central axis 206 of the boom 208 in the manner of a Yagi-Udi antenna tailored for the higher of the two antenna system operating frequencies, tailored for the frequency of 440 megahertz or 70 centimeters of wavelength in the case of a present invention satellite communication antenna system usable in the amateur radio bands. This tuning to amateur radio band frequencies is of course a convenience election that is useful for antenna experimentation purposes for example rather than being a limitation of the invention. Clearly antenna systems favoring other more restricted operating frequencies including frequencies assigned for military usage and commercial usage are reasonably considered to come within the scope of the invention.

The six dipolar elements spaced along the central axis 206 of the boom 208 in the plane 202 of FIG. 2 include an energy radiation or active element 212 connected to an electrical port 213 of the antenna system, a reflector element 214 located "behind" the active element 212 by a distance of about ¼ wavelength, and four director elements located "in front of" the active element 212. As disclosed in the materials recited in the above-identified handbook of Johnson and Jasik the use of one reflector element and the four director elements shown in the FIG. 2 antenna system is often a near optimum arrangement of a Yagi-Udi antenna for many purposes and adding additional elements, especially additional reflector elements, is significantly discouraged by the law of diminishing returns. Additional elements may also give rise to portability difficulties in the case of hand disposable use of present invention antenna system. The four director elements of the FIG. 2 plane 202 antenna system, the elements identified with the numbers 220, 222, 224 and 226 are preferably spaced at similar intervals along the boom 208, a spacing that is also in keeping with Yagi-Udi antenna practice.

The dipolar elements of the plane 202 in the FIG. 2 antenna system are preferably of slightly decreasing length along a progression from the reflector element 214 to the final director element 226. More precisely overall dipole lengths as described in Table 1 below are found to be desirable for the six elements 214, 212, 220, 222 224 and 226 respectively. The overall or total length of each dipolar element is achieved by way of a pair of "half elements" in combination with a centermost female receptacle or socket or sleeve portion as is also explained below. Visual details of these dipolar element lengths appear to the best degree possible in the three-dimensional view of the FIG. 2 drawing and to a somewhat better degree in the two dimensional view of the plane 202 antenna at 400 in the FIG. 4 drawing.

Figure 3:
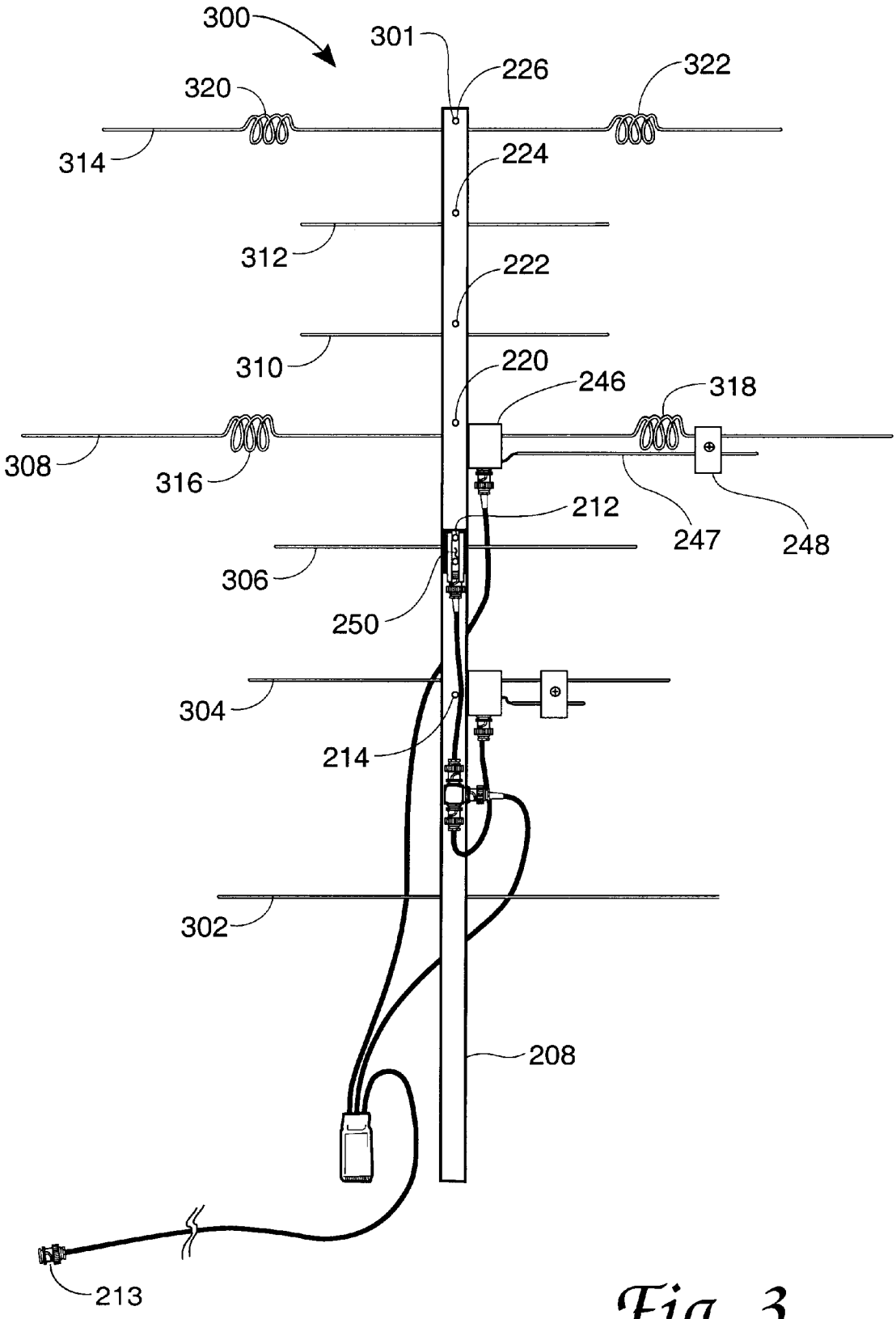
FIG. 3 shows one detailed side view of the FIG. 2 antenna.
Figure 4:
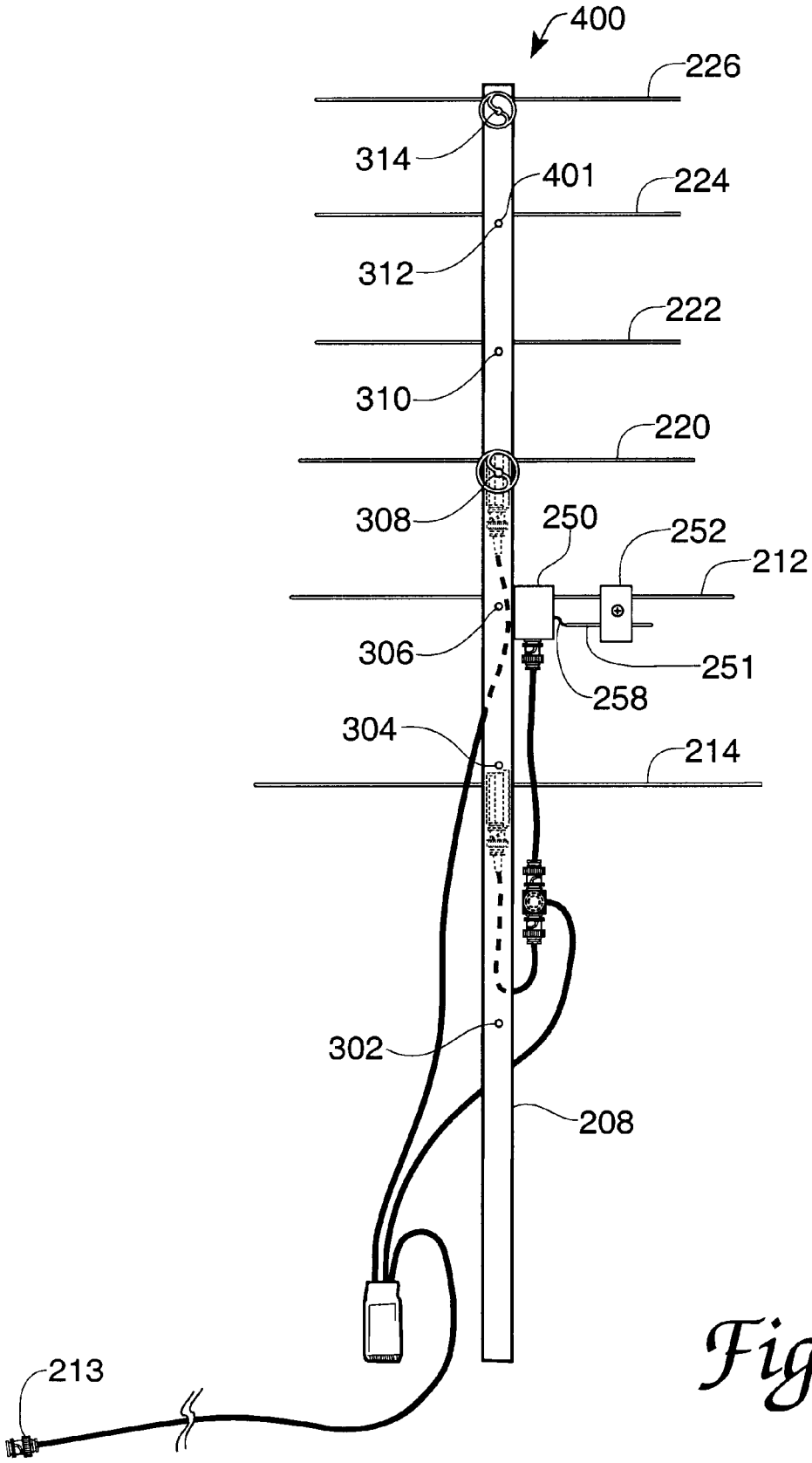
FIG. 4 shows a second detailed side view of the FIG. 2 and FIG. 3 antenna.

In this FIG. 4 view the antenna elements disposed in the orthogonal geometric plane 204 appear as the series of small circles 401 also disposed along the axis 206 of the boom 208. In a similar manner the elements 214, 212, 220, 222 224 and 226 disposed in the geometric plane 202 appear as the series of small circles 301 disposed along the axis 206 of the boom 208 in the FIG. 3 view of the present invention antenna system. Use of the present invention antenna system at other frequencies will of course have a direct effect on the recited dipolar element lengths with higher operating frequencies involving shorter element lengths as is known in the antenna.art. The directional view indication symbols at 228 and 230 in the FIG. 2 drawing indicate the nature of the two dimensional FIG. 4 and FIG. 3 drawings herein.

Continuing with the discussion of plane 202 elements 214, 212, 220, 222 224 and 226 in the FIG. 2 drawing, these elements may be fabricated from a wide variety of conductive and preferably metallic materials such as copper-based and aluminum-based materials. One material found to be particularly attractive for this use is the 3⁄32 inch brass alloy brazing rod as is readily available at low cost in the commercial marketplace. This material has been found to have a desirable combination of electrical conductivity, physical size and weight and an acceptable compromise between resiliency and stiffness. In the interest of antenna system portability and easy disassembly for carrying these brazing rod or other metal elements are preferably received in tight-fitting, electrical continuity-maintaining permanently boom-mounted sleeve or socket members 228, 230, 232, 234, 236 and 238 when the antenna system is in the assembled condition shown in FIG. 1, FIG. 2, FIG. 3 and FIG. 4. Additional details of this antenna element and sleeve arrangement appear in connection with the FIG. 5 drawing below. It is significant to note that the total antenna element lengths involved in the antenna system herein are overall element lengths comprised of two Table 1 half-element segments and the centermost boom attached half-element-connecting sleeve.

The boom member 208 in the FIG. 2 antenna system is of an electrical insulating characteristic and may also be made of a variety of materials. For experimental purposes fabrication of this boom member from a hardwood such as maple, ash, oak or hickory has proven satisfactory. In a non-experimental use of the invention the employment of weather resistant and possibly lighter-in weight embodiments of this boom is believed preferable. Such embodiments may for example involve the use of impregnated woven filament materials such as Textolite or fiberglass arranged in any of an open center box or rectangular box or circular tubular structural shape for example. The use of plastic materials such as Nylon, Delrin and Kevlar in either hollow or solid arrangements is also possible. The name of each of these latter materials is believed to be a registered U.S. Trademark owned by a Fortune 500 U.S. international corporation. Foam based structures, waterproofed wood and the vinyl chloride materials commonly used in plastic plumbing piping may also be employed for the boom 208. The effects of wind and ice loading may require antenna stiffening and other consideration with the use of some of these materials, especially in the instance of non-hand-held permanent mounting of the antenna system. These materials may also be used in fabricating individual antenna element support arrangements, particularly in permanent mounting instances involving weather extremes in combination with the illustrated electrical trap elements.

Figure 5:
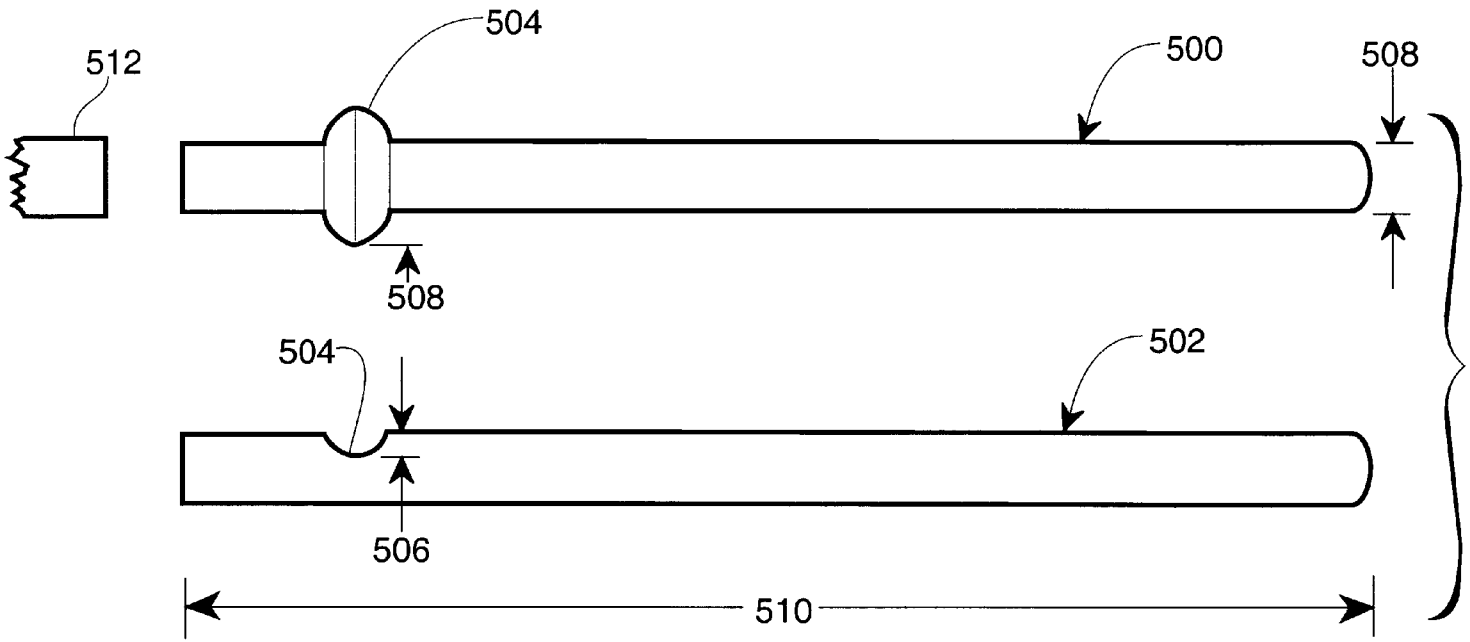
FIG. 5 shows details of a half element of the FIG. 2, FIG. 3 and FIG. 4 antenna.

Preferably the six elements 212, 214, 220, 222, 224 and 226 in the FIG. 2 antenna system and the corresponding seven elements in the orthogonal plane antenna 300 in FIG. 3 i.e., the elements 302, 304, 306, 308, 310, 312 and 314 are each comprised of the sleeve and "half element" portions identified above. Additional aspects of this sleeve and half element arrangement appear in the FIG. 5 drawing herein where details of a half element, a half element comprising a part of the active or radiator element 212 for example, and its mating sleeve member 230 are shown. As shown in FIG. 5 each of the half elements of the antenna system are preferably provided with a flattened or dimpled indentation resulting in an increased element diameter in the local region adjacent its innermost end in order to assure the element fits tightly and with good electrical continuity in its corresponding sleeve. This dimpled arrangement is effective with the above identified solid brass element stock or with other solid materials and may also be used with appropriate manufacturing care in the case of elements made from hollow tubing or other element cross sectional shapes.

In view of this description of the half element and sleeve arrangement usable in the preferred arrangement of the invention it may now be appreciated that the boom member 208 may also be fabricated of metal. Preferably hollow cross sectional shapes are selected for this usage especially in view of weight considerations and the potential hand-held portable nature of the antenna system. With such a metallic boom, as shown at 500 in FIG. 5, the individual sleeve elements for antenna half element capture may be provided with the desired electrical insulation from the metallic boom using individual electrical insulator members disposed between each sleeve and the metallic boom. Such individual electrical insulators may be made from the materials recited above for non metallic boom fabrication or from additional materials such as the ceramic or fired alumina materials used in outdoor electrical applications for many years. The individual sleeve members in FIG. 5 may for example be provided with threads and mating machine nuts in order to capture both the sleeve member and any mating insulator permanently in the boom member. A metallic boom member at 500 in FIG. 5 may be made of any of aluminum, stainless steel, zinc coated steel, brass or other materials. Alloys of aluminum and alloys of magnesium may be desirable for use in both the boom member and the antenna elements in arrangements of the invention concerned especially with weight. Need for the usual precautions involved with dissimilar metals located in damp environments and the possibility of electrolytic corrosion, especially in the half element to sleeve connections, prevail. The effect of a metallic boom element on the field pattern of the resulting antenna system must of course be considered when this option is selected.

Returning now to the FIG. 2 and FIG. 3 showings of the present invention antenna system, it may be appreciated that detailed discussion of the invention has thus far focused on the antenna elements disposed in the first of the orthogonal geometric planes 202 and 204, i.e., focused on elements located in the geometric plane 202 in FIG. 2. As has been implied in this thus-far discussion it is the addition of the antenna elements in the plane 204 to these elements in the plane 202 that provides the circular polarization characteristics to the FIG. 2 antenna system. The plane 204 elements also provide the lower frequency band characteristics of the present invention two-band antenna system. The seven antenna elements 302, 304, 306, 308, 310, 312 and 314 in the FIG. 2 and FIG. 3 antenna system view are also disposed along the central axis 206 of the boom 208 in the manner of a Yagi-Udi antenna tailored for the higher of the two antenna system operating frequencies, tailored for the frequency of 440 megahertz in the case of a satellite communication antenna system usable in the amateur radio bands. In addition to this disposition according to the Yagi-Udi spacing of the higher of the antenna two operating frequencies it is notable that the plane 204 antenna elements 300 (as are most readily appreciated in the FIG. 3 drawing) also include two dipolar elements having longer overall lengths, lengths further inclusive of tuned trap member pairs 316–318 and 320–322. The most efficient pairs of frequency bands for the FIG. 3 antenna are those bands in which the arrangement of the higher frequency yagi elements is such that an integer multiple of the higher band element spacing equals or nearly equals the lower band element spacing.

The tuned trap members 316, 318, 320 and 322 are each selected to resonate at the frequency of the FIG. 4 antenna elements i.e., to a frequency of 440 megahertz in the case of the amateur band antenna system, and operate in the manner of conventional tuned trap elements to enable both high band and low band resonances in the elements 308 and 314 of the FIG. 2 and FIG. 3 antenna system. This tuning is preferably accomplished by selecting initial physical dimensions for the traps as are calculated or measured to lie slightly above the desired trap frequency and then changing the initial physical dimensions by stretching or compressing the trap coil to adjust the resonant frequency to the desired location. A grid dip meter or voltage standing wave (VSWR) measurement meter or other frequency calibrated measuring instrument may be used to track the results of this tuning. The above-identified brass brazing rod material is found to have structural rigidity sufficient to provide reasonable physical support for the outer lengths of the antenna elements 308 and 314 notwithstanding the intervening coiled spring physical effect of the trap elements 316, 318, 320 and 322. Conductors of greater cross sectional area or electrical insulating physical support members may however be used in the trap elements 316, 318, 320 and 322 if needed for support reasons in a particular embodiment of the invention.

Radio frequency energy coupling into and away from the active antenna elements 214 and 308 in the FIG. 2, FIG. 3 and FIG. 4 antennas may involve the antenna system port 212, a BNC coaxial cable connector, the several lengths of coaxial cable indicated at 232, 234, 236, 238 and 240 in the FIG. 2 drawing. This energy coupling function further includes the signal duplexer network 242, signal splitter element 244 for driving the 440 megahertz elements located in both planes 204 and 202, and three driven element impedance matching arrays or gamma matching arrays all as shown at 246, 247, 248; 250, 251, 252; 254, 255, 256 respectively. In the unbalanced gamma matching array shown at 246, 247, 248 for example there appears in FIG. 2 and in FIG. 3 the transmission line termination 246, the gamma rod 247 and the shunt 248. Similarly in the gamma matching array shown at 250, 251, 252 there appears in FIG. 2; and in FIG. 3 the transmission line termination 250, the gamma rod 251 and the shunt 252 and in the gamma matching array shown at 254, 255, 256 there appears in FIG. 2 and in FIG. 3 the transmission line termination 254, the gamma rod 255 and the shunt 252. The gamma-matching array shown at 250, 251, 252 in FIG. 2 also appears clearly in the FIG. 4 drawing.

These gamma matching arrays represent one of several possible arrangements by which the impedance of the coaxial cable transmission lines indicated at 232, 234, 236, 238 and 240 in the FIG. 2 drawing can be matched to the impedance of the antenna radiating elements over a desirable frequency range and without the occurrence of undesirably large energy reflections from the transmission line to antenna junction i.e., matched while maintaining desirably low voltage standing wave ratio or VSWR characteristics in the antenna and transmission line. Low voltage standing wave ratio or VSWR avoids the occurrence of poor signal coupling efficiency, unduly large voltages appearing in the transmission line elements and the transmitter for example and the inefficient use of transmitter energy. Additional information regarding the gamma match and other transmission line to antenna coupling arrangements is found for examples in the U.S. Pat. 2,976,532 of Guest; U.S. Pat. No. 4,184,165 of Yve; U.S. Pat. No. 5,072,233 of Zanzig; U.S. Pat. No. 5,424,751 of Collier and U.S. Pat. No. 5,790,081 of Unwin. Further information of this type is also available in several publications of The American Radio Relay League (ARRL) of Newington Conn. notably in The *ARRL Antenna Handbook* as published each year and especially in the eighth edition published in 1956 and in The *ARRL Handbook for Radio Amateurs* also published yearly and especially in chapter 17 of the 1992 edition. Each of these patent and publication references is hereby incorporated by reference herein.

According to gamma matching practice the element length location of each gamma rod to antenna element shunt 248, 252 and 256 in the FIG. 2, FIG. 3 and FIG. 4 antenna is selected to provide best match i.e., the lowest VSWR characteristic, over the band of frequencies of intended antenna system operation. This adjustment alters the inductive and capacitive coupling between gamma rod and antenna element as is explained in the incorporated by reference materials. The boom end of the gamma match-fed antenna elements in FIG. 2, FIG. 3 and FIG. 4 is grounded by connection to the shield conductor of the coaxial cable transmission lines feeding these elements in the transmission line termination elements 246, 250 and 254. The center conductor of these coaxial transmission line elements connects to a gamma rod-received capacitance wire, 258 for example, located within each tubular gamma rod 247, 251 and 255. The overall lengths of the gamma elements are recited in Table 1 below for an antenna system of the present frequency optimizations.

The transmission line termination elements 246, 250 and 254 in the FIG. 2 antenna system may be fabricated from aluminum or other metallic conductors materials; these termination elements include a drill-formed hollow interior region, a coaxial cable male connector and are preferably held in position on the boom member 210 by way of adjustable members such as plastic cable ties or rubber tension components as are typically represented at 260 in the FIG. 2 drawing. The antenna elements 212, 304, 308 received in these termination elements 246, 250 and 254 may extend completely through the termination elements and be received in sleeve elements mounted in the boom 210 in order to further retain the termination elements in the positions desired.

The signal duplexer network 242 provides signal separation between seventy-centimeter wavelength signals and two-meter wavelength signals involved with the operation of the invention. In the above discussed instance of the antenna system being used in a two way satellite communication link of differing UHF and VHF frequencies this network enables the use of a single transmission line 232 to provide connection with both a transmitter operating in the two meter band and a receiver operating in the seventy centimeter band. This signal combination and separation function may be viewed as a standard, known in the art, duplexing function allowing coincident transmission and reception, with the present invention antenna system. The duplexing network 242 may be comprised of frequency separation elements as are known in the art.

Thus far in this discussion the focus has been on the UHF elements of the FIG. 2, FIG. 3 and FIG. 4 antenna system, i.e., on the UHF elements disposed in the plane 202, and to a lesser degree on the attending UHF elements providing circular polarization in the UHF band as are disposed in the plane 204. In this discussion the plane 204 elements, as are shown most clearly in the FIG. 3 drawing, have been indicated to include both dedicated UHF elements and the two dual frequency elements 308 and 314, elements providing a VHF capability for the FIG. 2, FIG. 3 and FIG. 4 antenna system. The longer dual frequency elements 308 and 314 provide non-circularly polarized radiation from the FIG. 2, FIG. 3 and FIG. 4 antenna system in the VHF or two meter band of operation. This non-circular polarization radiation has proven satisfactory for the earth to satellite usage. It has in fact been observed with the present invention antenna system that the lower frequency antenna pattern is distorted in a favorable pattern by the higher frequency elements that contribute to circular polarization at the higher frequency. This favorable distortion leads to a nearly equal reception from any angle of polarization despite the lack of a cross-polarized lower frequency element. In communication situations needing circular polarization in the VHF band however it is of course possible to modify the FIG. 2, FIG. 3 and FIG. 4 antenna system with the substitution of elements similar to elements 308 and 314 located in the plane 202 i.e., in the FIG. 4 element array. Such longer dual frequency elements may for example be substituted for the UHF elements 220 and 226.

Signal coupling with such additional dual frequency elements may be accomplished in the manner of the signal splitter element 244 used for UHF circular polarization in the FIG. 2 and FIG. 3 drawings. Tuned traps in the nature of those shown at 316, 318, 320 and 322 and elongated gamma rod coupling as used at 247 in FIG. 2 and FIG. 3 may be used with these additional VHF circular polarization elements. Field strength measurement experience has suggested the two-element arrangement of the VHF antennas shown in FIG. 2 and FIG. 3 provides directional and gain performance sufficient to limit the benefit of additional reflector and director elements in either the circular polarization or non-circular polarization arrangements of the present invention antenna system. For critical need situations, also tolerant of the increased overall size involved, such additional elements may be added to the antenna system in respective of the planes 202 and 204. Laboratory testing has however shown difficulty to arise in tuning a circularly polarized signal at the lower frequency. Fabrication of the antenna system with only a single plane at the lower frequency is therefore deemed an easier and less costly alternative.

As is indicated above, for portability purposed it is desirable for the FIG. 1 and FIG. 2 antenna system to be easily disassembled and containable in a small hand-cartable package; this disassembly desirably includes the antenna elements themselves. FIG. 5 in the drawings therefore shows at 500 and 502 respectively top view and side view details of one UHF half element of the FIG. 1 and FIG. 2 antenna system. In the FIG. 5 drawing the element diameter of 3/32 inch as recited above is indicated at 508 and the half element length is indicated at 510. The length shown at 510 is of course slightly less than one-half of the desired complete element length in view of the total length of each dipolar element being achieved by way of a pair of "half elements" of length 510 in combination with a portion of the center-most female receptacle or socket or sleeve portion 512 permanently mounted in the boom member 210 of the FIG. 1 and FIG. 2 antenna system. With three quarter inch boom member cross sectional dimensions the half elements and their socket or sleeve portion 512 can be conveniently arranged to provide a total additional element length of about one quarter inch when element and sleeve telescoping details are considered. Half element dimensions for both the UHF and VHF elements of the FIG. 1 and FIG. 2 antenna systems are disclosed in the following Table 1. The element identifications recited in Table 1 are in accordance with those shown in FIG. 2. The largest length dimensions disclosed for the UHF/VHF elements in the Table 1 data include the length of the tuned trap elements 316, 318, 320 and 322; the smaller of these dimensions excludes the trap elements. Separation distances or gap length for the gamma match elements are also provided in Table 1. The half element lengths recited in Table 1 are achieved by theoretical wavelength calculations followed by optimization tuning accomplished with a standing wave ratio bridge and a field strength measurement apparatus.

TABLE 1

MEASURED ANTENNA HALF ELEMENT LENGTHS

| FIG. 2 Element | FIG. 2 Plane | Function | Length 510 |
|---|---|---|---|
| 302 | 204 | UHF reflector | 6.56 inches |
| 304 | 204 | UHF active | 6.25 inches |
| 255 | 204 | UHF gamma match | 2.75 inches, 0.56 inch gap |
| 306 | 204 | UHF director | 6.81 inches |
| 308 | 204 | Trapped VHF active, UHF director | 16.31 inches, 5.75 inches |

TABLE 1-continued

MEASURED ANTENNA HALF ELEMENT LENGTHS

| FIG. 2 Element | FIG. 2 Plane | Function | Length 510 |
|---|---|---|---|
| 310 | 204 | UHF director | 5.00 inches |
| 312 | 204 | UHF director | 5.00 inches |
| 314 | 204 | Trapped UHF/VHF director | 16.63 inches, 6.5 inches |
| 214 | 202 | UHF reflector | 6.56 inches, |
| 212 | 202 | UHF active | 6.50 inches |
| 251 | 202 | UHF gamma match | 3.50 inches, 0.5 inch gap |
| 220 | 202 | UHF director | 5.82 inches |
| 222 | 202 | UHF director | 5.00 inches |
| 224 | 202 | UHF director | 5.13 inches |
| 226 | 202 | UHF director | 5.00 inches |

In addition to the dimensions recited in the above Table 1 it may be noted in the FIG. 1 and FIG. 2 drawings that plane 202 and 204 elements of the present antenna system that are most adjacent are separated by unequal distances along the lengthwise axis of the boom 210. This progression of element spacing is consistent with the arrangement of Yagi antennas in general.

FIG. 5 in the drawings shows two views of one half-element portion of the present invention antenna system. At 504 in the top and side views, 500 and 502, of FIG. 5 there is shown an indentation or distortion of the half element material that is found useful in achieving both a friction fit, telescopic, tight physical seating of the half element in the centermost female receptacle or socket or sleeve portion 512 and also achieving the stable low resistance electrical connection desired between half elements. The indentation or distortion 504 is preferably achieved by striking the half element end portion with some wedge-shaped tool such as a cold chisel or a blacksmith's anvil wedge or perhaps a cutting plier and may be arranged to provide an indentation depth 506 of about one tenth of the half element diameter.

This indentation or distortion 504 also results in a diameter increase in the half element as is represented at 508 in the FIG. 5 drawing and thereby achieves the desired tight frictional fit within the female receptacle or socket or sleeve portion 512 when this female receptacle or socket or sleeve portion is made of a material such as one eighth inch internal diameter brass tubing. Actually two or more of the indentation or distortions 504 may be useful in achieving the desired physical and electrical connection of half elements within receptacle or socket or sleeve portion 512. In addition to the increased diameter 508 resulting from the indentation or distortion 504 it is also found that the formation of this indentation or distortion tends to bend the leftmost end of the half element representation at 502 in FIG. 5 slightly downward or out of axial alignment with remainder portions of the half element. This slight half element bending can be arranged to be additionally useful in achieving the desired physical and electrical tight frictional connection of half elements with receptacle or socket or sleeve portion 512 in the assembled antenna system. The indentation or distortion (s) 504 may be disposed about two millimeters from the end of the half element 502.

As shown in the FIG. 1 and FIG. 2 drawings the antenna system of the present invention provides the circular polarization characteristic for only the UHF signal and thus accommodates true circular polarization in only one direction of a bi-directional communication link. Nevertheless tumble of a satellite having dipole antennas is provided-for by the favorable distortion of the lower frequency antenna patterns described earlier herein. Circular polarization characteristics may of course be provided for the VHF antenna by the addition of other VHF elements, active and passive, in the plane 202 of FIG. 2. These other elements may be of the tuned trap-inclusive variety as used at 308 and 314 in the FIG. 2 antenna system and thereby may be combined with selected of the UHF elements such as element 220 located in the plane 202. As in the case of the above described VHF elements in plane 204 the use of a VHF reflector element and plural VHF director elements is believed to be of limited field strength plot enhancement value in added plane 202 VHF elements, a two element VHF structure in plane 202 is therefore believed optimum.

Figure 6:
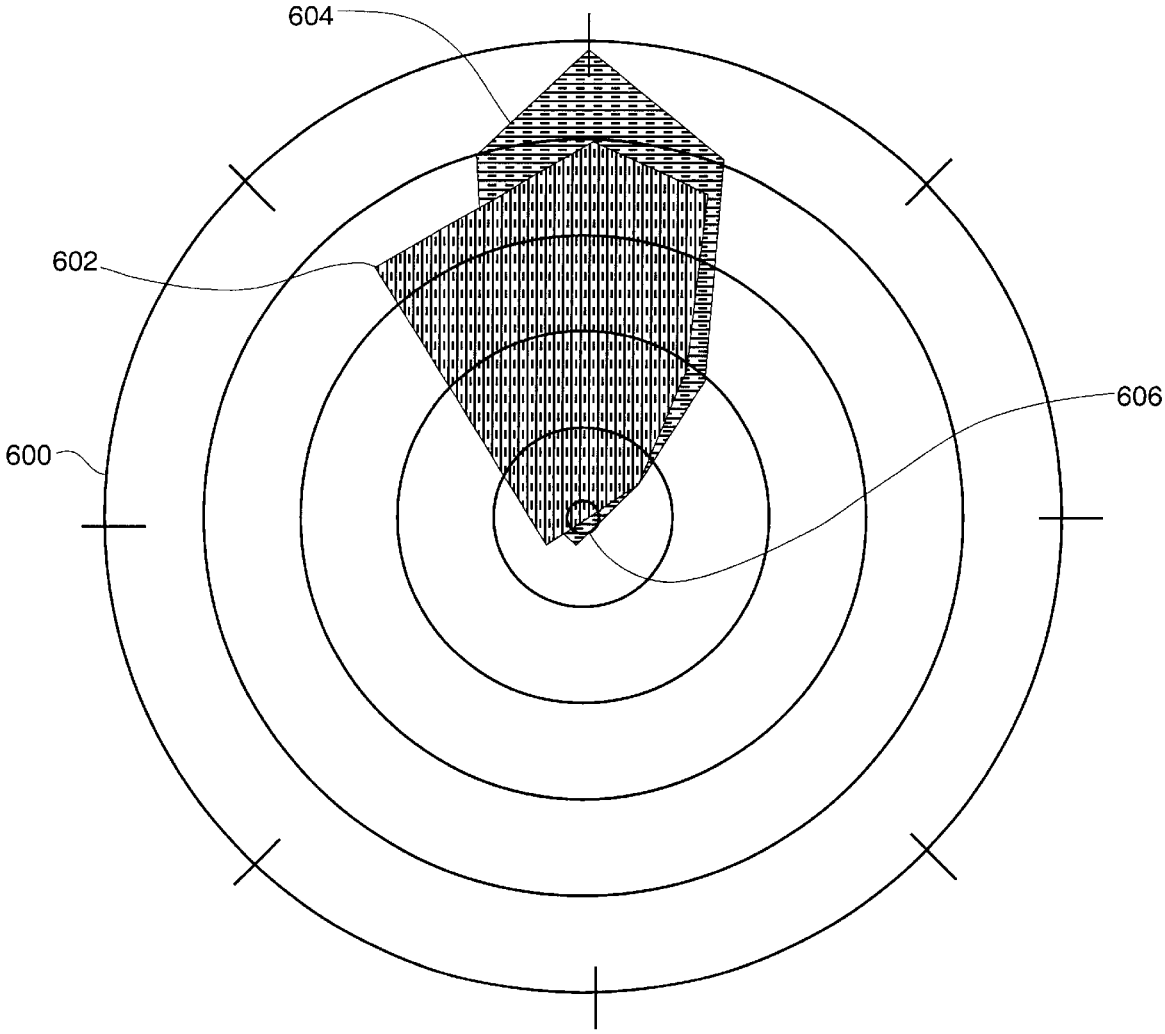
FIG. 6 shows a relative field strength plot for one portion of the antenna system of the present invention for a signal of two meters wavelength.

FIG. 6 in the drawings shows a relative field strength plot relating to the VHF performance of the FIG. 1 and FIG. 2 antenna system. In the FIG. 6 drawing there appears a polar grid 600 on which is imposed two plots 602 and 604 representing the relative field strength of signals originating in the VHF or two-meter elements of the FIG. 1 and FIG. 2 antenna system as an angular function of the receiving location around a point 606, a point representing the location of the emitting antenna system. The FIG. 6 polar grid includes graduations representing $\pi/4$ radian or 360/8 or 45 degree intervals and radial graduations representing increments of signal strength. Data represented in the FIG. 6 plot is taken at two points within each of the $\pi/4$ radian or 45 degree intervals so that the FIG. 6 plot actually represents a total of 16 data points in each of the plots 602 and 604.

The plot at 602 in FIG. 6 represents the magnitude of signals received in a plane perpendicular to that of the emitting VHF antenna system elements and the plot at 604 represents the magnitude of signals received in a plane parallel to that of the emitting VHF antenna elements. With respect to the FIG. 2 drawing and its planes 202 and 204, the plot 602 represents therefore the strength of signals received from emitting elements 308 and 314 as these signals are received at points in the plane 202 lying perpendicular to that of the emitting elements. Conversely the plot 604 represents the strength of signals received from emitting elements 308 and 314 as these signals are received at points in the plane 204 lying parallel to that of the emitting elements. The relatively small signal strength difference between the plots 602 and 604 indicates the VHF antenna elements of the FIG. 1 and FIG. 2 antenna system to have undergone a favorable distortion for use in cross polarized situations.

Figure 7:
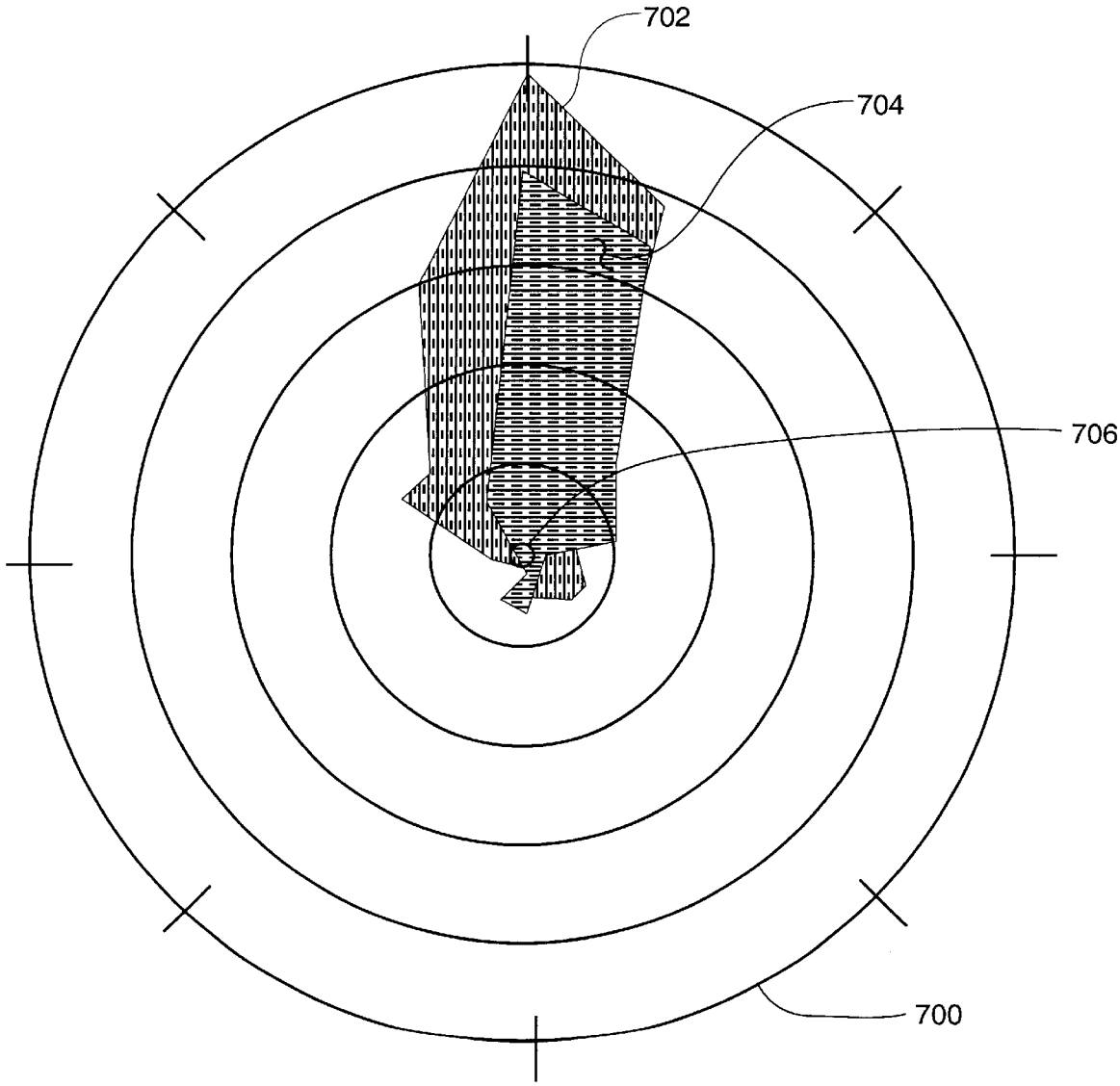
FIG. 7 shows a relative field strength plot for another portion of the antenna system of the present invention for a signal of seventy centimeters wavelength.

FIG. 7 in the drawings shows a relative field strength plot of the FIG. 6 type for the 70 centimeter or UHF elements of the FIG. 1 and FIG. 2 antenna system. In the FIG. 7 drawing there appears a polar grid 700 on which is imposed two plots 702 and 704 representing the relative field strength of signals originating in the UHF or 70 centimeter wavelength elements of the FIG. 1 and FIG. 2 antenna system as an angular function of the receiving location around a point 706, a point representing the location of the emitting antenna system. The FIG. 7 polar grid also includes graduations representing $\pi/4$ radian or 45 degree intervals and radial graduations representing signal strength. The plot at 702 in FIG. 7 represents the magnitude of signals received in a plane perpendicular to that of the emitting VHF antenna elements and the plot at 704 represents the magnitude of signals received in a plane parallel to that of the emitting VHF antenna elements. With respect to the FIG. 2 drawing and its planes 202 and 204 the plot 702 represents therefore the strength of signals received from all of the emitting elements, including the UHF portions of the tuned trap elements 308 and 314, as these signals are received at points in the plane 202 lying perpendicular to that of the emitting elements. Conversely the plot 704 represents the strength of signals received from emitting elements 308 and 314 as these signals are received at points in the plane 204 lying parallel to that of the emitting elements. The relatively small signal strength difference between the plots 702 and 704 indicates the desired freedom from rotational symmetry with the satellite's antenna has been achieved. The method involved includes the application of one-quarter wave space-delayed simultaneous signals as the driven elements at ultra high frequency.

Turning now to the question of standing wave ratio (SWR) and the ability of the present invention antenna system to transduce received transmission line electrical energy into emitted radiation rather than reflections back into the transmission line and its energy source, measurements indicate a SWR or 1.3 to 1 can be achieved by the VHF elements of the FIG. 1 and FIG. 2 antenna system. This ratio is maintained over a frequency range of 144 to 148 megahertz. In the case of the UHF elements of the antenna system a SWR of 1.3 to 1 is achieved over a frequency range of 440 to 448 megahertz.

Fabrication of the present invention antenna system is believed fairly described as a low cost task. Excepting for the coaxial cable fittings and the signal divider networks the materials employed are of common usage and ready availability from numerous commercial sources, primarily sources outside the electronic industry. These common materials have been estimated to be available for less than five dollars for each antenna system constructed. Materials more sophisticated or advantageous than the wood and brass brazing rods used in the described embodiment of the invention may of course be desirable in a large quantity usage or in a commercialized realization; even these materials are believed however to remain in the low cost classification especially in view of the limited quantities involved in each antenna system.

The foregoing description of the preferred embodiment has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the inventions in various embodiments and with various modifications as are suited to the particular scope of the invention as determined by the appended claims when interpreted in accordance with the breadth to which they are fairly, legally and equitably entitled.

I claim:

1. Dual band circular polarization-capable portable antenna apparatus comprising the combination of:

an ultra high radio frequency first array of dipolar antenna elements disposed in a first geometric plane and extending along an antenna boom member in ultra high radio frequency Yagi/Uda element separations;

said ultra high radio frequency first array of dipolar antenna elements including an ultra high radio frequency energy radiator element disposed intermediate an ultra high radio frequency reflector element and a plurality of ultra high radio frequency director elements along said antenna boom member;

an ultra high radio frequency and very high radio frequency second array of dipolar antenna elements extending in ultra high radio frequency Yagi/Uda element separations along said antenna boom member within a second geometric plane orthogonal of and coaxial of said first geometric plane;

said ultra high radio frequency and very high radio frequency second array of dipolar antenna elements including an ultra high radio frequency energy radiator element disposed intermediate an ultra high radio frequency reflector element and a plurality of director elements, including dual radio frequency wavelength director elements of combined very high radio frequency and tuned wave-trap limited ultra high radio frequency effective electrical lengths, along said antenna boom member;

said dual radio frequency director elements of combined very high radio frequency and tuned wave-trap limited ultra high radio frequency effective electrical lengths additionally comprising a very high radio frequency-tuned antenna energy radiator element and a very high radio frequency-tuned antenna director element;

said ultra high radio frequency and very high radio frequency second array of dipolar antenna elements extending in said second geometric plane along said antenna boom member in interspersed antenna elements relationship with said first geometric plane first array of ultra high radio frequency dipolar antenna elements; and an electrical signal frequency responsive and signal phase splitting electrical network apparatus disposed intermediate an electrical port of said circularly polarized portable antenna apparatus and each of said antenna energy radiator elements;

said signal phase splitting electrical network of said electrical signal frequency responsive and signal phase splitting electrical network apparatus having output signal ports connecting with said ultra high radio frequency energy radiator elements of said first and second arrays of dipolar antenna elements in circular polarized wave generating element phasing determination.

2. The dual band circular polarization-capable portable antenna apparatus of claim 1 wherein said antenna elements are each comprised of half element length conductors electively joined together by boom member-received conductive sleeve members.

3. The dual band circular polarization-capable portable antenna apparatus of claim 2 wherein said half element length conductors are comprised of elongated brass rod of less than one quarter inch diameter.

4. The dual band circular polarization-capable portable antenna apparatus of claim 1 wherein each of said radio frequency energy radiator elements includes a gamma rod-inclusive impedance matching element.

5. The dual band circular polarization-capable portable antenna apparatus of claim 4 wherein said impedance matching element includes a gamma rod shorting element disposed lengthwise along each said radiating element in response to a standing wave ratio-responsive location algorithm.

6. The dual band circular polarization-capable portable antenna apparatus of claim 1 wherein said electrical signal frequency responsive and signal phase splitting electrical network apparatus comprises a separately embodied electrical signal frequency responsive network connected with a plurality of electrical signal phase splitting networks.

7. The dual band circular polarization-capable portable antenna apparatus of claim 1 wherein said ultra high radio frequency is a frequency of 440 megahertz with a wavelength of seventy centimeters and said very high radio frequency is a frequency of one hundred forty four megahertz with a wavelength of two meters.

8. The dual band circular polarization-capable portable antenna apparatus of claim 7 wherein said ultra high radio frequency arrays of dipolar antenna elements are comprised of antenna half-element portions of five to six and six tenths inches physical length and said very high radio frequency arrays of dipolar antenna elements are comprised of antenna half-element portions of sixteen and three tenths to sixteen and seven tenths inches physical length inclusive of tuned trap elements.

9. The dual band circular polarization-capable portable antenna apparatus of claim 8 wherein said antenna element arrays comprise antenna elements distributed along a boom axial length of thirty one and one-half inches and include element to element axial spacings between four and one-half and six and one-half inches.

10. The dual band circular polarization-capable portable antenna apparatus of claim 1 wherein said ultra high radio frequency first array of dipolar antenna elements is comprised of a total of six antenna elements and said ultra high radio frequency and very high radio frequency second array of dipolar antenna elements is comprised of a total of seven antenna elements.

11. The dual band circular polarization-capable portable antenna apparatus of claim 1 wherein said antenna comprises a component of one of a military ground to aircraft communication link, a ground to satellite communication link and a ground to ground communication link.

12. Hand-held circular polarization inclusive dual frequency band satellite communication antenna apparatus comprising the combination of:

a first array of dipolar electrical radiation elements located in a first plane radially disposed with respect to an antenna longitudinal axis;

said first array of dipolar electrical radiation elements including a first active radiating element and a plurality of passive director-reflector electrical elements each tuned to first frequency band electrical lengths and dispersed along said antenna longitudinal axis;

a second array of dipolar electrical radiation elements located in a second plane radially disposed with respect to said antenna longitudinal axis and orthogonally disposed around said longitudinal axis with respect to said first plane;

said second array of dipolar electrical elements including a pair of active radiating elements and a plurality of passive director-reflector electrical elements each tuned to first frequency band electrical length and dispersed along said antenna longitudinal axis;

said second array of dipolar electrical elements also including a plurality of doubly tuned, electrically resonant trap-inclusive, dipolar electrical elements of combined first frequency and lower second frequency electrical wavelengths lengths; and an electrical energy coupling network connected with said active radiating elements and with an electrical energy port of said antenna apparatus;

said electrical energy coupling network including electrical energy dividing and electrical energy phasing portions.

13. The hand-held circular polarization inclusive dual frequency band satellite communication antenna apparatus of claim 12 wherein said first and second arrays of dipolar electrical radiation elements comprise electrical energy radiating, reflecting and directing elements disposed in Yagi/Udi element spacings along said antenna longitudinal axis.

14. The hand-held circular polarization inclusive dual frequency band satellite communication antenna apparatus of claim 12 wherein said arrays of dipolar electrical radiation elements are comprised of removable half element conductors received in socket sleeves along said antenna longitudinal axis.

15. The hand-held circular polarization inclusive dual frequency band satellite communication antenna apparatus of claim 12 wherein said electrical energy phasing portion includes electrical signal phase determining apparatus connecting with said first active radiating element and said pair of active radiating elements and generating circular polarization radiation-related element energization signals.

16. The hand-held circular polarization inclusive dual frequency band satellite communication antenna apparatus of claim 12 wherein said second array dipolar electrical elements comprise one antenna radiating element and one antenna directing element and wherein said double tuning comprises one VHF frequency tuning and one UHF frequency tuning.

17. The hand-held circular polarization inclusive dual frequency band satellite communication antenna apparatus of claim 12 further including an electrically insulating hand-disposable antenna boom member located along said antenna longitudinal axis.

18. The hand-held circular polarization inclusive dual frequency band satellite communication antenna apparatus of claim 12 wherein said electrical energy dividing portion of said electrical energy coupling network comprises a frequency selective electrical network.

* * * * *

UNITED STATES PATENT AND TRADEMARK OFFICE

CERTIFICATE OF CORRECTION

PATENT NO. : 6,606,074 B1
DATED : August 12, 2003
INVENTOR(S) : Richard A. Allnutt It is certified that error appears in the above-identified patent and that said Letters Patent is hereby corrected as shown below:

Column 6,
Line 20, "vol. Jun. 16, 1928," should read -- vol. 16, Jun. 1928, --.

Column 16,
Line 47, "claim 2" should read -- claim 1 --.

Signed and Sealed this

Sixth Day of July, 2004

JON W. DUDAS
*Acting Director of the United States Patent and Trademark Office*